US008272345B2

(12) United States Patent
Robertson et al.

(10) Patent No.: US 8,272,345 B2
(45) Date of Patent: Sep. 25, 2012

(54) ELECTROSPRAYING/ELECTROSPINNING ARRAY UTILIZING A REPLACEMENT ARRAY OF INDIVIDUAL TIP FLOW RESTRICTION

(75) Inventors: John A. Robertson, Chillicothe, OH (US); Ashley Steve Scott, Grove City, OH (US)

(73) Assignee: Nanostatics Corporation, Circleville, OH (US)

( * ) Notice: Subject to any disclaimer, the term of this patent is extended or adjusted under 35 U.S.C. 154(b) by 135 days.

(21) Appl. No.: 12/626,978

(22) Filed: Nov. 30, 2009

(65) Prior Publication Data

US 2010/0071619 A1 Mar. 25, 2010

Related U.S. Application Data

(62) Division of application No. 11/634,012, filed on Dec. 5, 2006, now Pat. No. 7,629,030.

(51) Int. Cl.
*B05B 5/025* (2006.01)
*B05B 7/06* (2006.01)

(52) U.S. Cl. ..... 118/629; 118/627; 118/313; 118/315

(58) Field of Classification Search ..... 118/620–640, 118/313–315, 308; 239/692, 698, 701–707, 239/690, 697, 548, 550, 556, 557, 566; 347/55, 347/77

See application file for complete search history.

(56) References Cited

U.S. PATENT DOCUMENTS 4,562,095 A * 12/1985 Coulon et al. ..... 427/180
2003/0143315 A1 * 7/2003 Pui et al. ..... 427/2.1

* cited by examiner

*Primary Examiner* — Yewebdar Tadesse
(74) *Attorney, Agent, or Firm* — David S. Alavi

(57) ABSTRACT

An electrohydrodynamic spraying or spinning deposition system, which includes a common source of pressurized liquid within a manifold, and an array of 2 or more spraying tips, each tip being fed from the common source of pressurized liquid to create a liquid flow path. An individual flow impedance device is disposed within each tip's individual liquid flow path from the pressurized liquid source into each spraying tip. The individual flow impedance devices are disposed within a replaceable sheet, which can be easily cleaned or changed to accommodate the instance liquid viscosity and composition. A high voltage source is applied to create a high voltage potential applied between the tip array and a deposition surface.

12 Claims, 4 Drawing Sheets

ELECTROSPRAYING/ELECTROSPINNING ARRAY UTILIZING A REPLACEMENT ARRAY OF INDIVIDUAL TIP FLOW RESTRICTION

CROSS-REFERENCE TO RELATED APPLICATIONS

This application is a divisional application of U.S. Ser. No. 11/634,012, filed Dec. 5, 2006, now U.S. Pat. No. 7,629,030, the disclosure of which is expressly incorporated herein by reference.

STATEMENT REGARDING FEDERALLY SPONSORED RESEARCH

Not applicable.

BACKGROUND OF THE INVENTION

The present invention generally relates to the production of small or so-called "nano" fibers or droplets, which may be "spun" as fibers or "sprayed" as droplets by applying high electrostatic fields to liquid filled spraying tips, producing a Taylor cone at the tip opening. Thandavamoorthy Subbiath, G. S. Bhat, R. W Tock and S. S. Ramkumar, in the article, "Electrospinning of Nanofibers", *Journal of Applied Polymer Science*, Vol. 96, 557-569 (2205), Wiley Periodicals, Inc., is instructive in this field. As the aforementioned article points out at page 561, there has been a debate on the potential and practicality of scaling up the technology to produce nanofibers at deposition rates required for commercial application.

Much of the reported basic R&D on the electrospinning of nanofibers has utilized a single spraying tube (typically a square cut tip end on a hollow hypodermic tube). In that prior art, the liquid flow into individual tips is typically regulated using a positive displacement pump (one pump per needle). If a positive displacement liquid tip flow is not provided individually to each spinning needle, the flow of liquid into the electrospinning orifices may be quite unstable. In order to reach commercial deposition rates, the inventor envisions the need for thousands of spraying orifices comprising an "Electrospinning Array"—the use of individual positive displacement pumps becomes impractical when this many tips are employed.

U.S. Pat. No. 6,713,001 teaches the use of separate positive displacement pumps, as well as altering the local electric fields of selected tips. Although the '001 proposes that a pressured liquid or a single positive displacement pump alone can be utilized to make spinning arrays, the only examples there utilize a single spraying tip fed by a positive displacement pump. It is the inventor's opinion that a single pressurized fluid or a single positive displacement pump cannot feed a practical large spinning array consisting of many individual tubes, which are otherwise unrestricted in their flow. This is opined because the flow rate of each individual unrestricted tip is inherently unstable vis-à-vis its neighbor tube. Changes in the electrostatic field on one tip caused by changes in the charged fibers or droplets in the gap (created partially by neighboring tip(s) spinning or spraying) affects that tip's flow by electrostatically affecting the effective surface tension balance at that tip's fluid projection. This in turn affects the flow (effective pressure) into other tips and, thus, the instability is maintained.

In an attempt to work around the flow instabilities alluded to above, Kim and Park (WO 2005/090653 A1) teach an array of tips spinning upward against gravity with each tip provided with excess liquid. The excess (dripping) flow, then, is individually collected in a scavenging gap, which is coaxial to each spinning tip. The excess liquid drips do not then contaminate the product onto which the spun fibers are being applied. Kim and Park also teach the use of air flow in yet another gap, yet coaxial to the spinning tip to keep the Taylor cone producing tip liquid lofted against gravity and thereby shaped to enable the startup of Taylor spinning. Kim and Park also teach the use of a funnel shaped tip to aid in shaping the Taylor pool. The collection of the excess flow from many tips, all elevated at high voltage with respect to the product, means that the collected fluid needs to pass through an insulating "liquid drop isolator" for return to the sourcing liquid pump. The teachings of Kim and Park, thereby, result in a complicated head, which contains many fluid flow paths, many flow adjustments, and precision machined parts to simply keep the drippings from reaching the product. This inventor notes that a drawing in WO 2005/090653 A1 shows the fluid path leading to the spraying tip, as a very thin line, and might be construed to be a capillary. No claims are made concerning this path and it would be most difficult to form (drill) a working capillary having appropriate length to diameter ratios.

Andrady, et al. in Patent Application Publication US 2005/0224998 A1 discloses an attempt to control fluid flows in a plurality of spinning (extrusion) tips through the use of a common electrode within the fluid source manifold.

BRIEF SUMMARY OF THE INVENTION

Beginning with an analogy, the high sensitivity of robust spinning to field intensity and hydrostatic pressure brings to mind the analogy of the widely appreciated characteristics of a diode circuit (See, FIG. 1), wherein the voltage/current characteristics are depicted in FIG. 2. After the applied voltage (V), 101, (much like the hydrostatic pressure, $P_o$, or field, E) exceeds a meniscus surface tension threshold, $V_f$, 105, the current, 102, (much like liquid flow) increases rapidly. Maintaining a fixed current at $I_{x1}$, 106, (much like maintaining a fiber production spinning or spraying flow) requires a very tightly controlled applied voltage (hydrostatic pressure or E field in our analogy). Small changes in the diode, 103, characteristics (analogous to small changes in viscosity, density, surface tension, or conductivity) also will vary $I_{x1}$ 106 greatly.

In FIG. 3, we have added a series resistance, $R_{th}$, 104, to the circuit of FIG. 1 to, thereby, produce the V-I characteristics shown in FIG. 4. Note that the maintenance of a $I_{x2}$, 107, value by altering V is much more stable as V or the diode characteristics vary. In the spinning analogy, a series impedance added to the liquid flow path will facilitate electrohydrodynamic (EHD) spraying or spinning, which is much less sensitive to hydrostatic pressure, P, the E field at the spraying tip, or even the liquid parameters.

The present disclosure, therefore, is an Electrospinning or Electrospraying Array design that facilitates using as many spraying tips (J in number) as are required for production deposition. Each tip does not require a separate positive displacement pump or local field adjustment to balance between dripping and spinning or spraying. The present invention accomplishes flow matching for each tip through the use of J "Flow Constraining Resistances" (FCR), wherein the flow from a (preferably) common, pressurized fluid into each tip (n) is individually constrained to a flow rate, $F_n$. Providing nearly equal Flow Constraining Resistances to the individual flows, $F_1$ through $F_J$, thereby, provides nearly equal flow into each of the J tips in the array. Once the flow rate is established by placing a common designed FCR in each orifice flow path, the Taylor cone spinning or spraying for all n orifices may be adjusted by varying one or more of the following: the electrostatic field, the physical properties of the liquid, or the pressure of the common liquid pool. No individual orifice adjustments are required once acceptable global parameters are established.

The electrostatic field is nearly identical for all spraying tips and is first approximated by K*V/s, where V is the voltage potential applied between the spraying head and the parallel deposition plane spaced s from the spraying head and K is an intensification factor, which depends on the tip radius and geometry. Typically K is 1 (no extension into the gap) to 3 (Tube extending well into the gap). Here we make the simplifying assumption that the tips have minor electrostatic interactions and that the charged fiber or droplet cloud in the gap is uniform in its (field reducing) effects on each nozzle. The electrostatic interactions can be minimized by increasing the tip physical separations or by adding "shield electrodes". Note that the use of the term "fluid" includes materials or melts, which are liquid (fluent) at the instant temperature of the spinning device. Materials, which exhibit appropriate spinning viscosity and conductivity at elevated temperatures (e.g., solventless melts), may be employed within a heated spinning array. See, for example, "*Electrostatic Spraying of Liquids*" by Adrian G. Bailey, Research Studies Press LTD. Taunton, Somerset, England.

Appropriate materials for spinning/spraying for present purposes, then, includes pure materials, mixtures and combinations of two or more materials including, but not limited to, homogeneous mixtures, heterogeneous mixtures, where "mixtures" comprehends solutions, dispersions, emulsions, and the like; so long as the material(s) spun/sprayed are "fluent" or flowable through the equipment disclosed herein. Additionally, one or more reservoirs of materials (or mixtures of materials) can be sprayed/spun in adjacency to mix, coat, blend, or otherwise commingle with each other in forming the ultimate fibers. Moreover, the fibers from each reservoir can be of the same size or of a different size to create special affects. Materials for spraying/spinning, then, are to be interpreted broadly.

As used in this application, the term "tip" means an opening and its associated liquid projection (typically, a Taylor spraying or spinning cone). This tip may be at the end of a tube or at the end of a hole in an effectively planar surface.

The present disclosure, then, is an electrohydrodynamic spraying or spinning deposition system, which includes a common source of pressurized liquid, and an array of 2 or more spraying tips, each tip being fed from the common source of pressurized liquid to create 2 or more liquid flow paths. An easily cleaned, removable sheet provides an individual flow impedance device within each tip's individual liquid flow path. A high voltage source is applied to create a high voltage potential applied between the tip array and a deposition surface. For the sake of clarity, "spinning" and "spraying" are interchangeable terms for present purposes, as are the terms "electrospinning" and "electrospraying".

BRIEF DESCRIPTION OF THE DRAWINGS

For a fuller understanding of the nature and advantages of the present invention, reference should be had to the following detailed description taken in connection with the accompanying drawings, in which.

The drawings will be described in further detail below.

DETAILED DESCRIPTION OF THE INVENTION

The Fluid Flow Constraining Resistance (FCR) Concept

Figure 1:
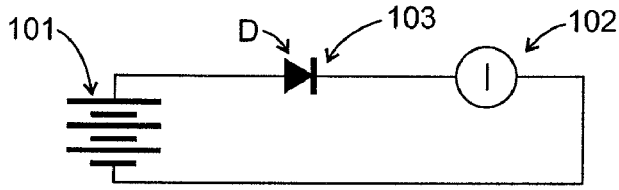
FIG. 1 is a schematic of a diode circuit.
Figure 2:
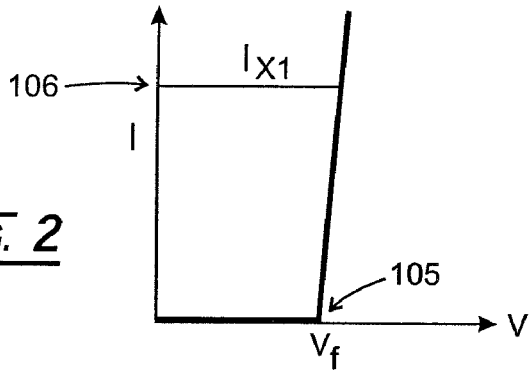
FIG. 2 is the voltage/current characteristics (curve) for the circuit of FIG. 1.
Figure 3:
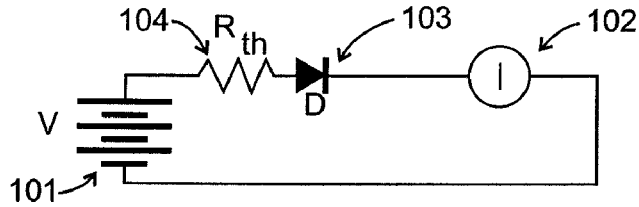
FIG. 3 is the schematic of FIG. 1 with an added series resistor.
Figure 4:
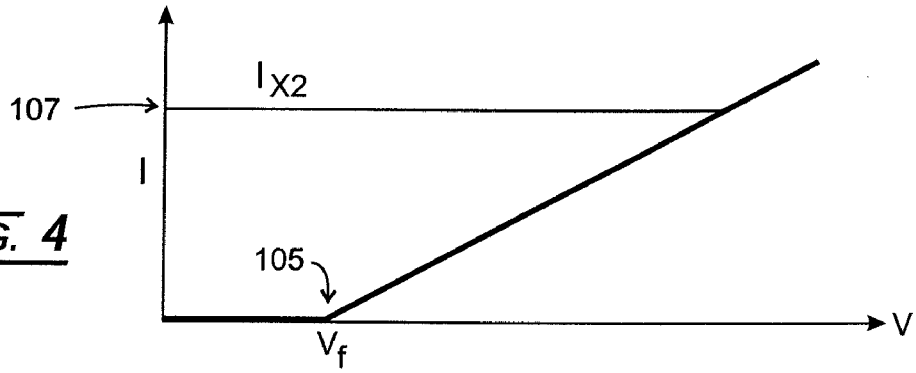
FIG. 4 is the voltage/current characteristics (curve) for the circuit of FIG. 3
Figure 5:
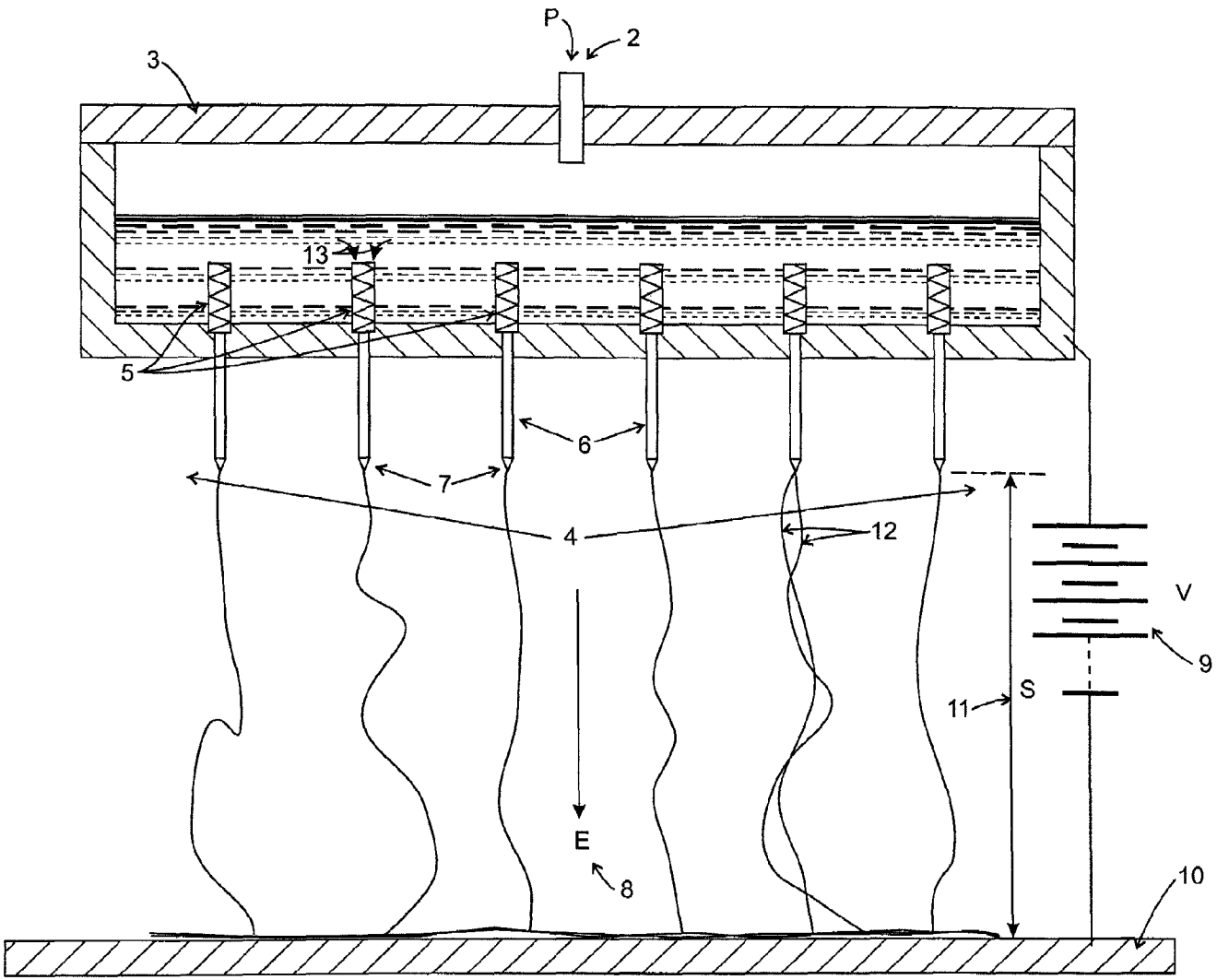
FIG. 5 is an introductory Taylor spraying or spinning apparatus or array set-up where a common source of pressurized fluid communicates with each individual spraying tip and each spray tip within the array has its own individual FCR, flow impedance device.

Referring initially to FIG. 5, we assume a fluid, 1, held at pressure P, 2, in a chamber manifold consisting of top, 3, and base, 45, common to the desired array of spraying tips shown partially at 4. Each spraying tip flow, 13, is individually restricted by its own FCR (flow control restrictor), 5, which limits the flow of liquid 1 into the individual spraying tubes, 6, which each leads to Taylor spraying flow at that tube's tip, 7, under the influence of an electrostatic field E, 8. E is initially approximated by the applied voltage, V, 9, divided by the orifice to deposition plane, 10, distance S, 11. The potential source 9 may be of either polarity. Potential source 9 also may be switched in polarity at a selected frequency with a duty cycle percentage for each polarity. Potential 9 also can be sinusoidal A.C. As a reminder, the term "fluid" includes materials that are liquid or fluid (i.e., fluent) at the instant temperature of the spinning device. Properly conductive materials that become liquid at elevated temperatures and/or with a solvent may be employed within an appropriately heated spinning array.

The resultant spun fibers (or droplets), 12, are directed onto the product, 99. Product 99 may be a single piece (including three dimensional objects) or a moving web of the product material, which is being coated. It may be necessary to modify either the surface or bulk conductivity of product 99 to assure that the top surface of product 99 is near to the electrostatic potential of deposition plane 10. Practitioners of the electrostatic art utilize a variety of techniques (including one or more of moisture addition to porous media, conductive films applied to otherwise insulating materials, and "tinsel" discharging of a moving surface), to minimize the charge accumulation on the gap side of product 99.

Note that for a given flow, the tip can spray in various modes depending on the fluid properties (viscosity, surface tension, and conductivity) and electrostatic field. See, for example, *Electrohydrodynamic Spraying*, by Anatol Jaworek and Andrzej Krupa, at http://www.imp.gda.pl/ehd/ehd_spry.html, where only the liquid (droplet) sprays are discussed. Similar modes exist when one spins fibers where, inter alia, solvent evaporation rate, surface tension, conductivity, and viscosity, become the important parameters that control whether an unbroken fiber results. Once the correct fluid is formulated for a given product application, a reliable spinning electrostatic coating system may require a control of the solvent (partial) vapor pressure in the gap.

FIG. 5 depicts flow 13 as entering into the top of schematic restrictors 5 simply to introduce the restrictor concept.

Note, that we have previously introduced the Taylor cone spinning to occur at an opening at the ends of a tube 6, which extends into gap E field. Alternatively, the spinning can occur at a near flush opening in the bottom of base 45. Such a flush opening results in less field intensification upon the Taylor cone, but may advantageously produce less field interaction between various openings. We choose to connote the various openings where Taylor spraying (spinning) occurs as the "tips" and acknowledge that the openings can be of various geometries and that other electrode configurations (e.g., shields or additional intensifying surfaces) are possible.

In the following discussion, we will disclose methods to restrict and, thereby, control the fluid flow into each "tip". These methods will be applicable whether the opening is at the end of a needle like tube extending into the E field (one extreme) or is a recessed opening in a planer electrode (the other extreme).

The design of the flow restrictor is highly dependent on the viscosity, μ, of the instant liquid being spun. By way of illustration, we will disclose and discuss 2 ways to create the desired flow constraining resistance (FCR). Our first examples will be configured as follows:

$V$=50 KV $s$=15 cm

Viscosity, μ=6.1 poise.

We assume that the selected liquids will all have sufficient conductivity to "spin" or "spray". Such conductivity adjustment (typically by ionic doping) is well understood by those skilled in the art (See, for example, "*Electrostatic Spraying of Liquids*", by Adrian G. Bailey, Research Studies Press LTD, Taunton, Somerset, England). We also assume that the liquid being spun may contain a volatile component, which evaporates to produce the desired solid (or tacky) fiber and that the liquid has surface tension and viscosity values appropriate for "spinning" fibers. The drawings for the following two Flow Restrictor types will detail only the pertinent restrictor details.

EXAMPLE 1

Fibrous or Micro Pore Sheet Flow Restrictor

Figure 6:
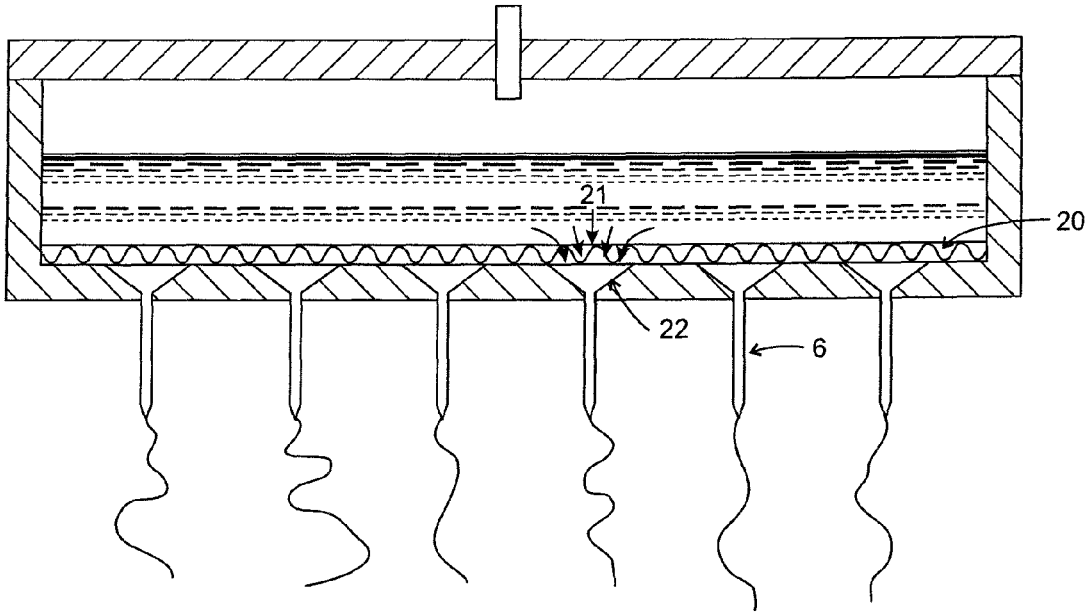
FIG. 6 is an embodiment of the Taylor spraying or spinning apparatus or array set-up of FIG. 5, where the spraying or spinning tubes with openings producing spraying or spinning tips are fed with pressurized liquid through a removable fibrous or micro porous sheet which acts as an FCR individually for each tip.

FIG. 6 depicts a portion of a spinning array (here using tubes 6 of about 2 mm inside diameter and about 1" apart to minimize electrostatic interactions), wherein a fibrous sheet, 20, restricts flow into each of the spraying tips. Using 24-Pound Bond paper as the fibrous sheet, we obtained a consistent flow for an water based fluid having a viscosity of μ=6.1 poise, as follows:

| | |
|---|---|
| 14 psi | .96 uL/min/tip |

Using filter paper (two layers of #4 Whatman Qualitative Brand catalog #1004150) as the fibrous sheet and a water based fluid having a viscosity of μ=6.1 poise, we obtained a consistent flow, as follows:

| | |
|---|---|
| 1 psi | 10 uL/min/tip |
| 5 psi | 31 uL/min/tip |
| 10 psi | 69 uL/min/tip |

Note, that the flow is measured by calculation after observing the time necessary to form a hemispherical droplet having the spraying orifice diameter (with the electrostatic field off). The high restriction to fluid flow caused by the fibrous sheet restrictor causes the flow to be nearly identical when the electrostatic field is applied. This feature minimizes tip-to-tip interactions, because the field has little effect on the total pressure drop between the pressurized fluid 1 entering the restrictor and the tip end. This assures a consistent fluid flow in all tips regardless of the tip's electrostatic field intensity variations—our goal.

We observed that the flow for 5 tubes in our first prototype array was matched to within 15% when using the bond paper. The flow was within 5% for all 5 nozzles when the (more uniform) filter paper was used. The ability to predictably set the flow over a 6:1 range for a number of spraying tips using a simple pressure regulator will be appreciated by anyone who has attempted to spin from multiple tips without the use of individual positive displacement pumps or has attempted to precisely match the several flow patterns in a tapped plenum.

In the fibrous sheet (or filter media), the flow into each spinning tube 6, shown, for example as a flow, 21, for one of the tips, is through the fibrous media and local to a relief opening, 22, which leads the flow into instant tube 6. The diameter of relief opening 22 controls the area of the fibrous media, which restricts the flow into the instant tip. A larger diameter of relief opening 22 or thinner fibrous mat 20 will increase the flow at a given liquid viscosity and pressure 2. For a given fluid viscosity, relief opening 22 diameter, the thickness and porosity of the fibrous media, and the fluid pressure, may all be adjusted to produce the desired spinning flow rate in all similarly sized tips within the (common fluid manifold) array.

A significant advantage of the use of a sheet of fibrous material 20 is that the entire sheet may be changed for cleanup or to accommodate different fluid viscosity ranges (or fibrous sheet wet ability or chemical compatibility with the instance fluid). Another advantage lies in its simplicity and low cost. For clarity, it is assumed that a fibrous material will be porous for passing through of the fluent material to be spun/sprayed.

We also disclose that the fibrous sheet may be a laminate of 2 or more sheets wherein the more porous (bottom) layer(s) provide bridging strength and the less porous (top) layer(s) provide the primary flow resistance without concern for their fragility. We also disclose the use of a replaceable flow-restricting sheet, which consists of micro pores (typically less than 5 micron effective diameter) in an otherwise impermeable membrane. Of course, hybrid stacking of restrictive layers of different types is possible and may be used to advantage.

A disadvantage of the fibrous (or filter media) or micro pore sheet is that neither can be used to electrospin or electrospray fluids, which contain (possibly desired) solid particles as they will be separated and clog the fibrous material as spinning flow progresses.

EXAMPLE 2

Pinhole Replaceable Sheet

We propose the use of a small orifice, radius r or diameter d, preferably in a thin, impermeable, and replaceable sheet. This inventive flow restriction enables the spinning or spraying array to utilize liquids, which may contain small particulates.

If the liquid has very low viscosity (say, less than about 10 centipoises), we can use the kinetic energy conservation to show that the flow volume V through such a pinhole is proportional to both the square of the orifice radius and the square root of the liquid pressure across the orifice. The flow also is inversely proportional to the square root of the liquid's viscosity, to wit:

$$V=\pi r^2\sqrt{(2\,P/\mu)}$$

We find experimentally that all liquids, which electrospin well into fibers, have viscosities above about 100 centipoises. For these more viscous liquids, the above-mentioned equation does not correctly predict the orifice flow. A much closer prediction to the orifice flow may be obtained using the following capillary flow equation:

$$\text{Flow}=0.00173(d^4P/\mu l),$$

where:

Flow is in μL per minute;

d is the I.D. of the orifice (um);

P is the pressure end to end of the capillary (PSI);

μ is the viscosity (Poise); and l is the thickness of the thin plate (μm).

Of special interest is the fact that it is practical to produce accurate small holes in thin materials using a variety of techniques. Holes, which are much smaller than the I.D. of practical capillary tubes, can readily be produced in thin materials. For example, we have produced 37-micron diameter (±5%) holes in various polyester films using focused laser pulses, needle piercing, heated tips, and mechanical drillings. PTFE films are especially desired for laser drilling.

Figure 7:
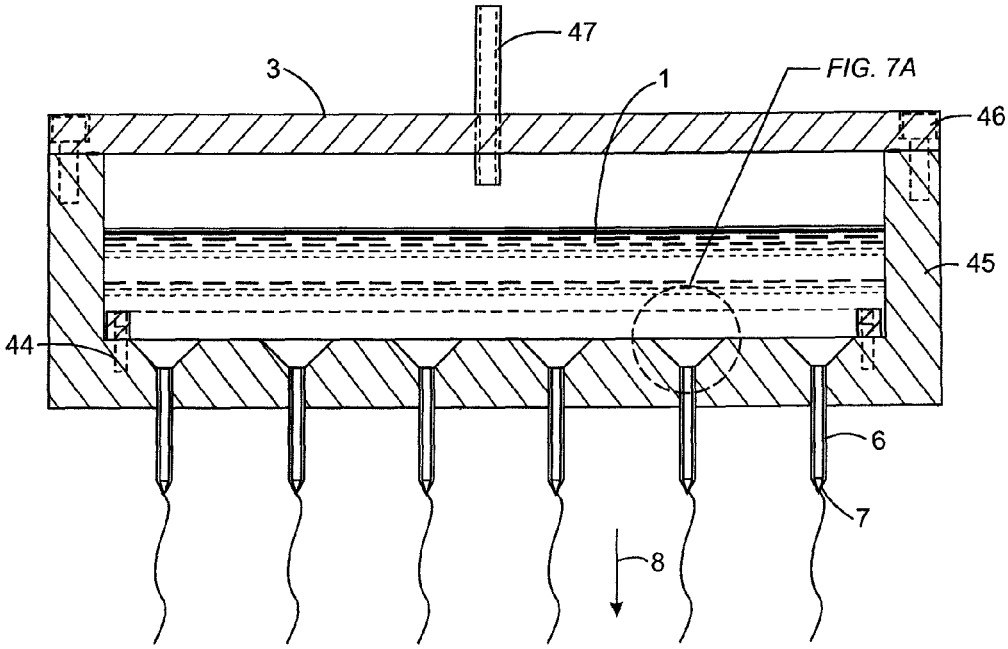
FIG. 7 is another embodiment of the Taylor spraying or spinning apparatus or array set-up of FIG. 5, where the spraying or spinning tubes with openings producing a spraying or spinning tip are fed with pressurized liquid through individual pinholes through a removable impermeable sheet which acts as an FCR individually for each tip.

Referring now to FIG. 7, which depicts a number of spraying tubes 6 each producing a spraying tip at 7. Each of these tubes is fed with pressurized liquid 1 through its individual pinhole, 40, through an otherwise impermeable sheet, 41. Thus, each tube tip 7 is supplied with a liquid 1 flow similar to that provided to other tips in the array. In practice, the tubes 6 are much larger in diameter than the restricting pinholes 40 and the effect of the gap field 8 is much less than the effect of the hydrostatic pressure of fluid 1. The tip flows are, thereby, determined overwhelmingly by the fluid 1 pressure, the fluid 1 viscosity, and the related orifice 40 dimensions. Preferably, the tubes 6 have an I.D. larger than, say, 400 microns, to permit them to be easily cleaned (by reaming or high velocity flow with the restrictor removed) if material dries, agglomerates, or cures within the tube bore.

For example, the flow of a 1100 centipose liquid pressurized to 2 psi through a 50-micron diameter hole in a 100-micron thick sheet will limit the tip flow to about 20 microliters per minute with no gap field 8. If the gap field 8 is then switched on to a typical spinning field of 2.5 KV/cm in the gap, the field at the tip (due to a nominal 3× enhancement of the field at a conductive protuberance) will be about 7.5 KV/cm. Such a field will produce a "surface pressure" calculated to be approximately 0.0006 psi upon the liquid at the spinning tip, a value, which is negligible when compared to the 2 psi manifold pressure.

Relief areas 22 assure that tubes 6 can be slightly misaligned with respect to its pinhole, 40, and still feed liquid into the instant spraying tube. The collection area of relief areas 22 does not affect the orifice flow since it is assumed that impermeable sheet 41 seals around the periphery of relief area 22 and the flow proceeds only through pinhole 40 each having a diameter, d.

Figure 7A:
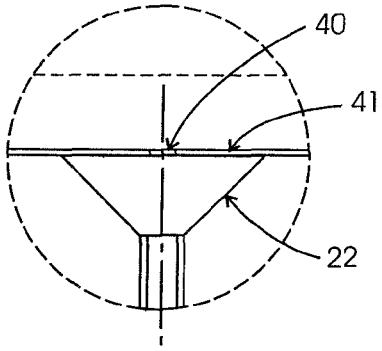
FIG. 7A is an exploded view of one of the spraying or spinning tubes with openings shown in FIG. 7.

Note in FIG. 7A, pinhole 40 orifices' size is exaggerated for clarity. The pinholes 40 are typically quite small; about 25 microns to, say, about 100 microns in diameter. By comparison, spraying tubes 6 and thus the tops of tips 7 typically are about 200 microns to about 2000 microns in inside diameter. For a given desired spinning or spraying flow, more viscous liquids require larger pinholes or higher fluid pressure. Tubes 6 have negligible effect on the tip flow when they are much larger in inside diameter than the associated pinhole 40.

Figure 8:
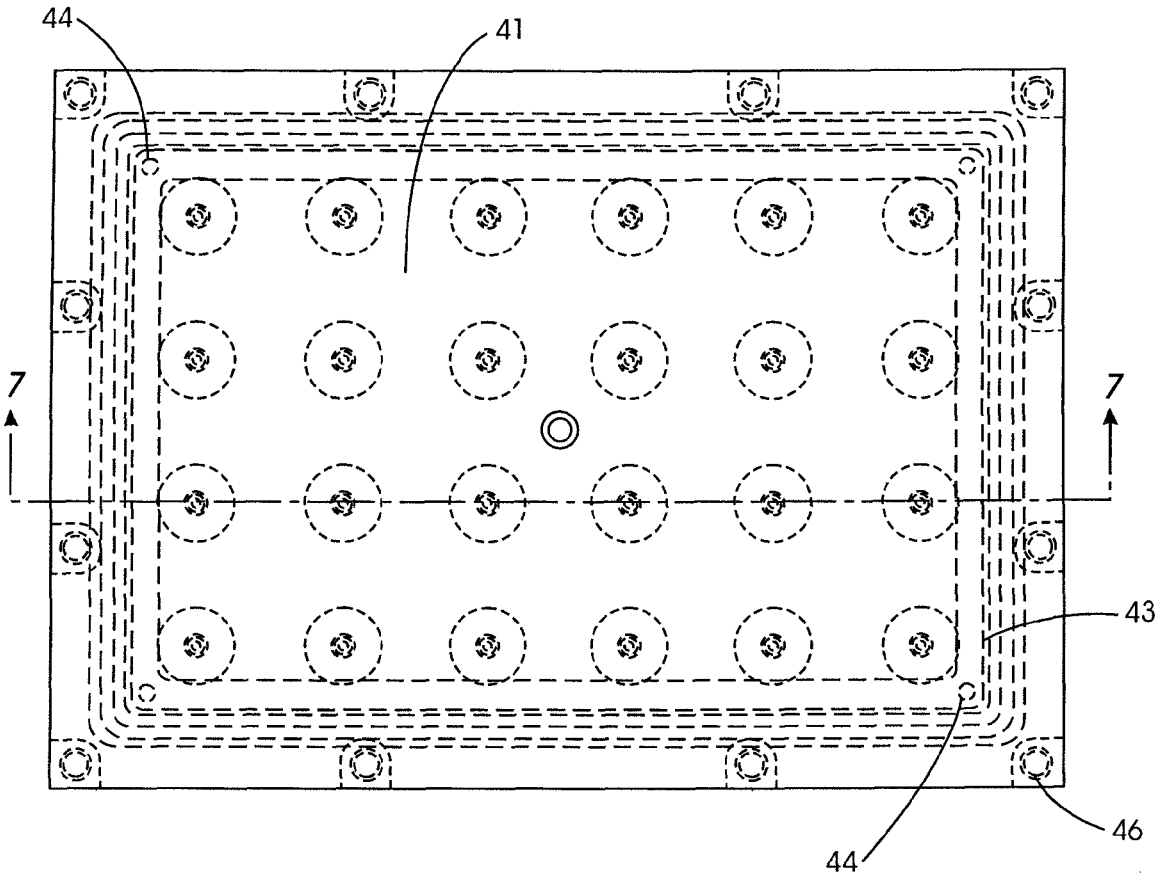
FIG. 8 is a plan view of FIG. 7.

The pinhole containing impermeable sheet 41 is preferably easily removable and replaceable for flow adjustment for a given fluid, and/or periodic cleaning. The preferable way to utilize the removable and replaceable pinhole array is further depicted in FIG. 8, which is a plan (top) view of FIG. 7, wherein the impermeable sheet, 41, is affixed to an edge frame, 43, which is accurately positioned over the relief areas 22 by virtue of indexing dowel pins, 44, within the liquid containing pressurized manifold consisting of base, 45, and removable lid 3.

The interchangeable, replaceable pinhole array can thereby be manufactured elsewhere and inserted into a head through removable lid 3, which then is reattached to the base 45 by utilizing fasteners, 46. The assembled head containing the pinhole array then is filled with liquid 1 and pressurized through tube 47 to produce the restricted flow through each of the of the pinhole restrictions 40, thence through tubes 6, and further to the electrostatic field exposed spinning or spraying tips 7 which are exposed to the electrostatic field 8.

The small pinholes 40 may become clogged with debris or the agglomeration of (possibly desirable) particles within fluid 1. The ability to quickly replace the entire restrictor array will be an easily appreciated feature in a production operation.

Pinholes 40 are conveniently formed, for example, by one or more of mechanically drilled, punched, laser drilled, chemically etched, or electroformed (if sheet 41 is metal). Alternatively the pinholes may be drilled, punched, or thermally produced (e.g., by melting through with a heated point or laser beam) when sheet 41 is polymeric. A more costly and complex fabrication is possible whereby impermeable sheet 41 carries numerous small orifice components, such as jewel orifices.

While the invention has been described with reference to several embodiments, those skilled in the art will understand that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed, but that the invention will include all embodiments falling within the scope of the appended claims. In this application all units are in the system indicated and all amounts and percentages are by weight, unless otherwise expressly indicated. Also, all citations referred herein are expressly incorporated herein by reference.

We claim:

1. An electrohydrodynamic spraying/spinning deposition system comprising:

(a) a common source of pressurized fluent material within a manifold;

(b) an array of 2 or more spraying/spinning tips, each one of the tips being fed from the common source of pressurized fluent material so as to provide a corresponding flow path for the fluent material;

(c) a corresponding individual flow impedance device disposed within the corresponding flow path of each one of the tips between that tip and the pressurized fluent material source, each individual flow impedance device comprising a corresponding set of one or more orifices, wherein the sets of orifices for the tips of the array are formed in a common replaceable liquid-impermeable sheet;

(d) a deposition surface; and (e) a high voltage source adapted and connected to create a high voltage potential applied between the tip array and the deposition surface.

2. The electrohydrodynamic spraying/spinning deposition system of claim 1, wherein the pressurized fluent material is pressurized to between about 0.01 and about 100 psi.

3. The electrohydrodynamic spraying/spinning deposition system of claim 1, wherein a portion of the flow path between each spraying/spinning tip and the corresponding set of orifices comprises a corresponding cavity having a larger transverse extent than the spraying/spinning tip and the corresponding set of orifices, and each corresponding cavity is separated from the common source of fluent material by the liquid-impermeable sheet.

4. The electrohydrodynamic spraying/spinning deposition system of claim 1, wherein a portion of the flow path between each spraying/spinning tip and the corresponding set of orifices includes a corresponding tube which extends the corresponding tip into an electric field of the high voltage potential.

5. The electrohydrodynamic spraying/spinning deposition system of claim 1, wherein a portion of the flow path between each spraying/spinning tip and the corresponding set of orifices includes a tube having an inner diameter greater than about 250 μm.

6. The electrohydrodynamic spraying/spinning deposition system of claim 1, wherein each set of orifices comprises (i) one or more orifices between about 10 μm and about 200 μm in diameter or (ii) a cluster of orifices having a total effective area between about 78 $\mu m^2$ and about 31000 $\mu m^2$.

7. The electrohydrodynamic spraying/spinning deposition system of claim 1, wherein the orifices in the liquid-impermeable sheet are formed by one or more of mechanical drilling, laser drilling, electrochemical etching, electroforming, punching, perforating, or penetration by a heated point.

8. The electrohydrodynamic spraying/spinning deposition system of claim 1, wherein the liquid-impermeable sheet is removable from between the array of spraying/spinning tips and the common source of pressurized fluent material source.

9. The electrohydrodynamic spraying/spinning deposition system of claim 8 wherein a portion of the flow path between each spraying/spinning tip and the corresponding set of orifices comprises a corresponding cavity having a larger transverse extent than the spraying/spinning tip and the corresponding set of orifices, and each corresponding cavity is separated from the common source of fluent material by the liquid-impermeable sheet upon insertion of the sheet into the manifold.

10. The electrohydrodynamic spraying/spinning deposition system of claim 1, wherein the liquid-impermeable sheet is attached to a frame which is indexed to position each set of orifices within the corresponding flow path upon insertion of the sheet into the manifold.

11. The electrohydrodynamic spraying/spinning deposition system of claim 10 wherein a portion of the flow path between each spraying/spinning tip and the corresponding set of orifices comprises a corresponding cavity having a larger transverse extent than the spraying/spinning tip and the corresponding set of orifices, and each corresponding cavity is separated from the common source of fluent material by the liquid-impermeable sheet upon insertion of the sheet into the manifold.

12. The electrohydrodynamic spraying/spinning deposition system of claim 1, further comprising at least one additional manifold and, for each additional manifold, a corresponding array of spinning tips and set of flow impedance devices.

* * * * *

UNITED STATES PATENT AND TRADEMARK OFFICE

CERTIFICATE OF CORRECTION

PATENT NO. : 8,272,345 B2
APPLICATION NO. : 12/626978
DATED : September 25, 2012
INVENTOR(S) : Robertson et al.

It is certified that error appears in the above-identified patent and that said Letters Patent is hereby corrected as shown below:

In the claims

Column 10, line 14: remove 2nd instance of "source".

Signed and Sealed this
Fifth Day of January, 2016

Michelle K. Lee

Michelle K. Lee
*Director of the United States Patent and Trademark Office*